US007255473B2

(12) United States Patent
Hiranuma et al.

(10) Patent No.: US 7,255,473 B2
(45) Date of Patent: Aug. 14, 2007

(54) PORTABLE TIMEPIECE

(75) Inventors: Haruki Hiranuma, Chiba (JP); Nobukazu Omori, Chiba (JP)

(73) Assignee: Seiko Instruments Inc. (JP)

( * ) Notice: Subject to any disclaimer, the term of this patent is extended or adjusted under 35 U.S.C. 154(b) by 28 days.

(21) Appl. No.: 11/332,561

(22) Filed: Jan. 13, 2006

(65) Prior Publication Data

US 2006/0158964 A1 Jul. 20, 2006

(30) Foreign Application Priority Data

Jan. 17, 2005 (JP) ..... 2005-009392

(51) Int. Cl.
*G04B 27/00* (2006.01)
*G04B 37/00* (2006.01)
*G04B 29/00* (2006.01)

(52) U.S. Cl. ..... 368/288; 368/290; 368/308; 368/319

(58) Field of Classification Search ..... 368/184, 368/185, 288, 290, 109–194, 306–308, 319
See application file for complete search history.

(56) References Cited

U.S. PATENT DOCUMENTS 6,126,309 A * 10/2000 Bettelini et al. ..... 368/185
7,025,494 B2 * 4/2006 Oomori et al. ..... 368/190
7,192,182 B2 * 3/2007 Hiranuma et al. ..... 368/289
7,192,184 B2 * 3/2007 Hiranuma et al. ..... 368/319
2004/0071049 A1 * 4/2004 Hiranuma et al. ..... 368/319

* cited by examiner

*Primary Examiner*—Vit Miska
*Assistant Examiner*—Thanh S. Phan
(74) *Attorney, Agent, or Firm*—Adams & Wilks

(57) ABSTRACT

To provide a portable timepiece having high durability constructed by a constitution capable of promoting operability of attaching and detaching a crown and holding a crown in an unoperated state so as not to rotate the crown unpreparedly. In a winding stem pipe attached to a case body, a crown urged in a direction of separating from the case body by a coil spring (urging member) included in a crown cylinder portion of the pipe is removably provided to a case body outside projected portion of the winding stem pipe. An outer periphery of the case body outside projected portion is formed with a plurality of communicating grooves along a rotational direction of the crown, a plurality of attaching and detaching through grooves communicated to the communicating grooves and opened to an end face of the case body outside projected portion, and a plurality of holding grooves communicated with the communicating grooves and formed in a dead end state and contiguous to the through grooves. A plurality of engaging projected portion brought to and from the respective grooves are provided at a cover portion of the crown covering the case body outside projected portion.

12 Claims, 11 Drawing Sheets

PORTABLE TIMEPIECE

BACKGROUND OF THE INVENTION

1. Field of the Invention

The present invention relates to a portable timepiece having a structure of holding a crown such that the crown is not unpreparedly rotated.

2. Description of the Prior Art

There is a portable timepiece adopting a structure of locking a crown by utilizing mesh of screws such that the crown is not unpreparedly rotated in carrying the portable timepiece.

The crown locking structure is a structure in which a winding stem pipe is attached to a case body including a timepiece movement and a female screw portion of a main portion of the crown fitted to a case body outside projected portion is screwed to a male screw portion formed at an outer periphery of the case body outside projected portion of the pipe. Thereby, normally, the crown can be locked by screwing the main portion of the crown to the outer periphery of the case body outside projected portion. Further, in operating the timepiece movement, a winding stem arranged on an inner side of the winding stem pipe can be operated to rotate in a state of pulling to move the crown after disengaging the main portion of the crown from being screwed to the male screw portion (refer to, for example, Patent References 1, 2).

<Patent Reference 1> Japanese Utility Model Application No. 2-57175 (JP-UM-A-4-16394)

<Patent Reference 2> Japanese Utility Model Application No. 5-61093 (JP-UM-A-7-26792)

According to the portable timepiece having the crown locking structure utilizing the mesh of screws, when the crown is left without operating to rotate the crown for a long period of time, there is a case in which an abnormally large force is needed in releasing the crown from being locked by corroding the male screw portion and the female screw portion, or bringing about a biting phenomenon. Further, there is a case in which in accordance with operating to rotate the crown repeatedly, the female screw portion of the crown and the male screw portion of the winding stem pipe brought in mesh with each other are worn or ground. Thereby, a function of locking the crown is deteriorated.

SUMMARY OF THE INVENTION

It is an object of the invention to provide a portable timepiece capable of promoting operability of attaching and detaching a crown and having a high durability of a constitution for holding the crown such that the crown in an unoperated state is not unpreparedly rotated.

In order to resolve the above-described problem, according to the invention, there is provided a portable timepiece comprising a case body having a pipe attaching hole; a winding stem pipe having a case body outside projected portion arranged at an outer portion of the case body and insertingly attached to the pipe attaching hole; a crown having a crown cylinder portion inserted into the winding stem pipe and removably provided to the case body outside projected portion; an urging member included in the crown cylinder portion for urging the crown in a direction of separating from the case body; and holding means having a plurality of communicating grooves along a rotational direction of the crown, a plurality of attaching and detaching through grooves communicated with the communicating grooves and opened to an end faced of the case body outside projected portion, a plurality of holding grooves communicated with the communicating grooves, formed in a dead end shape and contiguous to the attaching and detaching through grooves, and a plurality of engaging projected portions brought to and from the respective grooves for holding the crown attachably and detachably to and from the case body outside projected portion.

According to the invention, in attaching the crown to the case body outside projected portion of the winding stem pipe, the crown is pushed to rotate. That is, first, the engaging projected portion of the holding means is matched to the attaching and detaching through groove, the crown is pushed to move to the case body against the urging member while passing the engaging projected portion through the through groove and thereafter, the crown is rotated by a predetermined angle to pass from the through groove to the communicating groove to thereby make the engaging projected portion opposed to the holding groove. Thereafter, the crown is released from being pushed. Thereby, simultaneously with pushing back the crown by an urge force of the urging member, the engaging projected portion is brought to the holding groove to be caught thereby. By catching the crown by the holding groove, the crown is positioned in an axial direction and a peripheral direction of the case body outside projected portion and can be locked (held) so as not to be rotated. Further, also in disengaging the crown from the case back outside projected portion, the crown is pushed to rotate. Also in this case, the crown is pushed to move to direct to the case body against the urging member and thereafter, the crown is rotated by a predetermined angle, the engaging projected portion is passed from the holding groove to the communicating groove to be brought to the through groove and thereafter, the crown is released from being pushed. Thereby, the crown is pushed back by an urge force of the urging member by passing the engaging projected portion through the through groove and the crown is disengaged from the case back outside projected portion.

As described above, according to the invention, there is constructed the constitution in which the crown is held so as not to be rotated at the case back outside projected portion without needing screw portions at respectives of the case back outside projected portion of the winding stem pipe and the crown and therefore, even when the crown is left not to be operated for a long period of time, in releasing the crown from being locked, an abnormally large operating force is not needed, and the crown can be attached and detached to and from the case back outside projected portion of the winding stem pipe simply by operating to push to rotate the crown. Further, the holding means for locking the crown so as not to be rotated unpreparedly does not utilize mesh of screws and therefore, the holding means is difficult to be damaged in accordance with operation of attaching and detaching the crown and durability thereof is high.

According to a preferable embodiment of the invention, the communicating groove, the attaching and detaching through groove and the holding groove are provided at an outer periphery of the case body outside projected portion and the engaging projected portion is provided at a cover portion for covering the case body outside projected portion of the crown. According to the preferable embodiment, the communicating groove, the attaching and detaching through groove and the holding groove are formed by grooving the outer periphery of the case body outside projected portion of the winding stem pipe and therefore, the constitution is preferable from a view point of improving workability thereof.

Further, according to a preferable embodiment of the invention, a guide portion for guiding to move the engaging projected portion when the engaging projected portion passes the communicating groove is formed at the outer periphery of the case body outside projected portion in a ring-like shape continuously in a peripheral direction. Further, according to a preferable embodiment of the invention, a case body outside face of the case body serves as the guide portion for guiding to move the engaging projected portion when the engaging projected portion passes the communicating groove. According to the preferable embodiments, in operating to push to rotate the crown to be held at the case back outside projected portion, the engaging projected portion can be passed to the communicating groove by restricting a position of finishing to push the crown by the guide portion and rotating the crown by a predetermined angle while guiding the engaging projected portion by the guide portion in the restricted state. Thereby, it is restrained to hamper the crown from being operated to rotate owing to a deficiency in pushing the crown and therefore, the constitution is preferable from a view point of facilitating to operate to attach and detach the crown.

Further, according to a preferable embodiment of the invention, the communicating groove is formed between a peripheral face portion of the case body outside projected portion disposed between one end in the peripheral direction of the case body outside projected portion of the holding groove and the through groove contiguous thereto and the guide portion, other peripheral face portion of the case body outside projected portion disposed between other end in the peripheral direction of the case body outside projected portion of the holding groove and the through groove contiguous thereto serves as a rotation stop portion, and the rotation stop portion is made to be continuous to the guide portion. According to the preferable embodiment, a rotational direction in the case of operating to push to rotate the crown can be determined by the rotational stop portion, by butting the engaging projected portion to the rotation stop portion, the engaging projected portion can be positioned to the through groove and the holding groove and therefore, the constitution is preferable from a view point of facilitating to operate to attach and detach the crown.

Further, according to a preferable embodiment of the invention, the cover portion is fixed with a ring projected with the engaging projected portion to direct in an inner direction. According to the preferable embodiment, it is not necessary to work the engaging projected portion on an inner side of the cover portion of the crown, in a single state of the ring, the engaging projected portion can be worked thereto and therefore, the constitution is preferable from a view point of improving workability thereof.

Further, in order to resolve the problem, according to the invention, there is provided a portable timepiece comprising a case back comprising a molded member having a crown inserting hole and integrally having a case body outside projected portion to which the inserting hole is opened; a crown having a crown cylinder portion inserted into the crown inserting hole and provided removably at the case body outside projected portion; an urging member included in the crown cylinder portion for urging the crown in a direction of separating from the case body; and holding means having a plurality of communicating grooves along a rotational direction of the crown, a plurality of attaching and detaching through grooves communicated with the communicating grooves and opened to an end face of the case body outside projected portion, a plurality of holding grooves communicated with the communicating grooves, formed in a dead end shape and contiguous to the attaching and detaching through grooves, and a plurality of engaging projected portions brought to and from the respective grooves for holding the crown attachably and detachably to and from the case body outside projected portion.

According to the invention, in attaching the crown to the case body outside projected portion integrally formed to the case body, the crown is pushed to rotate. That is, first, the engaging projected portion of the holding means is matched to the attaching and detaching through groove, the crown is pushed to move to direct to the case back against the urging member while passing the engaging projected portion through the through groove and thereafter, the crown is rotated by a predetermined angle and the engaging projected portion is passed from the through groove to the communicating groove to be opposed to the holding groove. Thereafter, the crown is released from being pushed. Thereby, simultaneously with pushing back the crown by an urge force of the urging member, the engaging projected portion is brought to the holding groove to be caught thereby. By catching the engaging projected portion by the holding groove, the crown can be locked (held) so as not to be rotated by positioning the crown in an axial direction and a peripheral direction of the case body outside projected portion. Further, also in disengaging the crown from the case body outside projected portion, the crown is pushed to rotate. That is, the crown is pushed to move to the case back against the urging member and thereafter, the crown is rotated by a predetermined angle and the engaging projected portion is passed from the holding groove to the communicating groove to be brought to the through groove and thereafter, the crown is released from being pushed. Thereby, the crown is pushed back by the urge force of the urging member, the engaging projected portion passes through the through groove and the crown is disengaged from the case back outside projected portion.

As described above, the invention is constructed by the constitution holding the crown so as not to be rotated at the case back outside projected portion without needing screw portions at respectives of the case body outside projected portion integrated with the case back and the crown and therefore, even when the crown is left not to be operated for a long period of time, in releasing the crown from being locked, an abnormally large operating force is not needed, and the crown can be attached and detached to and from the case back outside projected portion of the case back simply by operating to push to rotate the crown. Further, the holding means for locking the crown so as not to be rotated unpreparedly does not utilize mesh of screws and therefore, the holding means is difficult to be damaged in accordance with operation of attaching and detaching the crown and durability thereof is high.

According to a preferable embodiment of the invention, the communicating groove, the attaching and detaching through groove, and the holding groove are provided at an outer periphery of the case back outside projected portion and the engaging projected portion is provided at a cover portion for covering the case back outside projected portion of the crown. According to the embodiment, the communicating groove, the attaching and detaching through groove and the holding groove are formed by grooving the outer periphery of the case body outside projected portion of the winding stem pipe and therefore, the constitution is preferable from a viewpoint of improving workability thereof.

Further, according to a preferable embodiment of the invention, a case back outside face of the case back serves as a guide portion for guiding to move the engaging projected portion when the engaging projected portion passes the communicating groove. According to the preferable embodiment, when the crown is rotated to push to rotate to be held by the case back outside projected portion, the engaging projected portion can be passed through the communicating groove by restricting a position of finishing to push the crown by the guide portion constituted by the case back outer face and rotating the crown by a predetermined angle while guiding the engaging projected portion and the guide portion in the restricted state. Thereby, it is restrained that operation of rotating the crown is hampered by a deficiency in pushing the crown and therefore, the constitution is preferable from a view point facilitating to operate to attach and detach the crown.

Further, according to a preferable embodiment of the invention, the communicating groove is formed between a peripheral face portion of the case back outside projected portion disposed between one end in a peripheral direction of the case back outside projected portion of the holding groove and the through groove contiguous thereto and the guide portion, other peripheral face portion of the case back outside projected portion disposed between other end in the peripheral direction of the case back outside projected portion of the holding groove and the through groove contiguous thereto serves as a rotation stop portion, and the rotation stop portion is made to be continuous to the guide portion. According to the preferable embodiment, by the rotation stop portion, a rotational direction in the case of operating to push to rotate the crown can be determined, by butting the engaging projected portion to the rotation stop portion, the engaging projected portion can be positioned to the through groove and the holding groove and therefore, the constitution is preferable from a view point of facilitating to operate to attach and detach the crown.

Further, according to a preferable embodiment of the invention, the cover portion is fixed with a ring projected with the engaging projected portion to direct in an inner direction. According to the preferable embodiment, it is not necessary to work the engaging projected portion on an inner side of the cover portion of the crown, in a single state of the ring, the engaging projected portion can be worked thereto and therefore, the constitution is preferable from a view point of improving workability thereof.

BRIEF DESCRIPTION OF THE SEVERAL VIEWS OF THE DRAWINGS

A preferred form of the present invention is illustrated in the accompanying drawings in which.

DETAILED DESCRIPTION OF THE PREFERRED EMBODIMENTS

A first embodiment of the invention will be explained in reference to FIG. 1 through FIG. 6.

Figure 1:
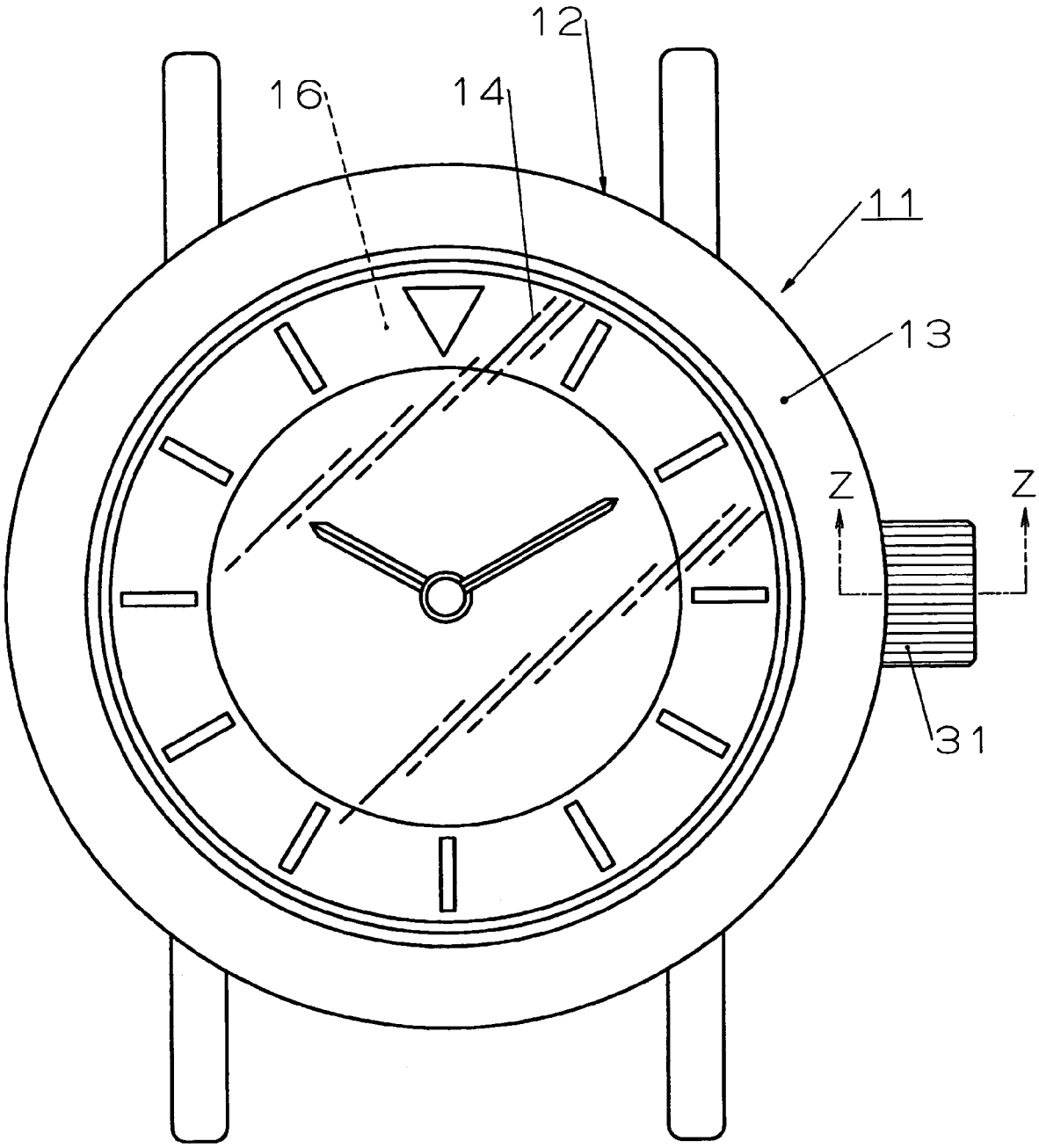
FIG. 1 is a front view showing a wristwatch according to a first embodiment of the invention.

In FIG. 1, notation 11 designates, for example, a wristwatch of a portable timepiece having a function capable of holding a crown such that the crown is not unpreparedly rotated when the crown is not used. The wristwatch 11 contains a timepiece movement, not illustrated, or the like at inside of a timepiece exterior assembly 12. The timepiece movement may be any of those constituting power by a small-sized battery or a mainspring, or constituted by automatic winding, in correspondence with a digital timepiece for displaying time or the like in digital on a dial by a quartz oscillation module, or using both of a constitution in correspondence with a digital timepiece and the other.

The timepiece exterior assembly 12 is formed by mounting in liquid tight cover glass 14 to one face in a thickness direction of a case body 13 made of a metal constituting a ring-like shape and mounting in liquid tight a case back 15 (refer to FIG. 2 and FIG. 3) comprising a metal or the like to a rear face in the thickness direction of the case body 13. A dial 16 or the like can be seen through the cover glass 14 and the case back 15 can be removed.

Figure 2:
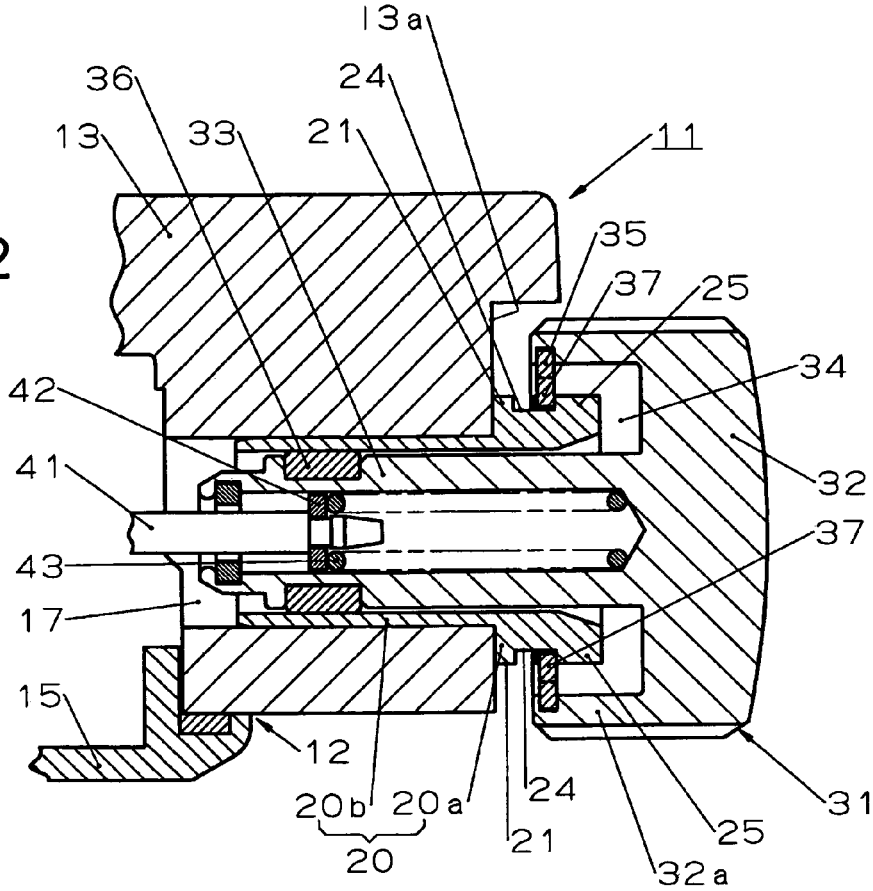
FIG. 2 is a sectional view taken along a line Z-Z of FIG. 1 showing a state of holding a crown at a case body outside projected portion.
Figure 3:
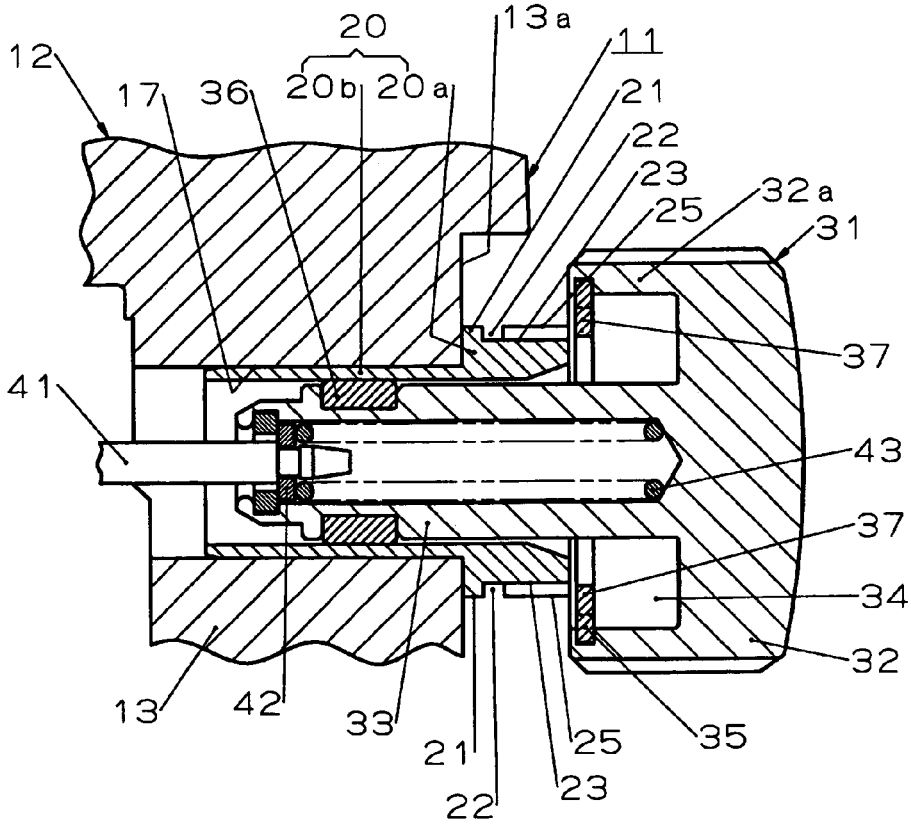
FIG. 3 is a sectional view taken along the line Z-Z of FIG. 1 showing a state of disengaging the crown from the case body outside projected portion.

As shown by FIG. 2 and FIG. 3, a portion of the case body 13 is provided with a pipe attaching hole 17 penetrated through the case body 13 in a diameter direction. One end of the pipe attaching hole 17 is opened to inside of the case body, that is, inside of the timepiece exterior assembly 12 and the other end of the pipe attaching hole 17 is opened to outside of the case body, that is, outside of the timepiece exterior assembly 12.

A winding stem pipe 20 is inserted into the pipe attaching hole 17 from outside of the case body to be fixed (insertingly attached). The winding stem pipe 20 is made of a metal, for example, stainless steel, and is formed by integrally connecting the inserting portion 20*b* and a case body outside projected portion 20*a* having diameters larger than a diameter of the inserting portion 20*b* as shown by FIG. 2 through FIG. 4 and the like.

The inserting portion 20*b* is a portion fixed by, for example, being inserted to the pipe attaching hole 17 from outside of the case body. In the fixing operation, the inserting portion 20*b* may be fixed in water tight to the case body 13 so as not to be able to be separated therefrom by using a brazing member made of a metal, not illustrated, or the inserting portion 20*b* may be screwed to the pipe attaching hole 17 by interposing a waterproof packing made of rubber between the case body 13 and the inserting portion 20*b* and the pipe attaching hole 17 and the inserting portion 20*b* may be adhered by an adhering agent. Further, the inserting portion 20*b* may be constituted by a length for penetrating the pipe attaching hole 17.

Figure 4:
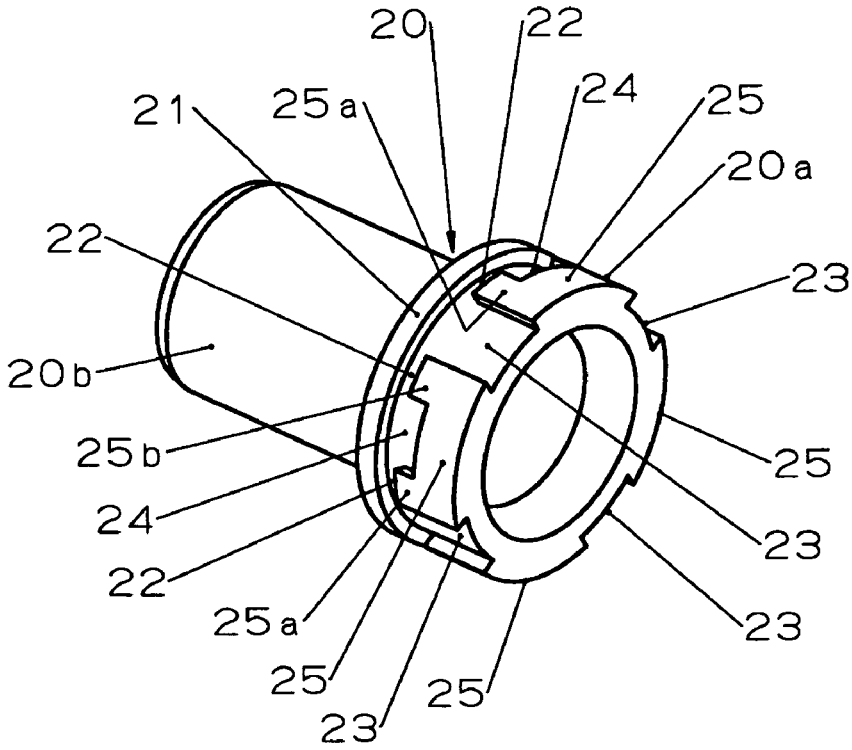
FIG. 4 is a perspective view showing a winding stem pipe provided to the wristwatch according to the first embodiment.

The case body outside projected portion 20*a* is a portion arranged at outside of the case body 13 and an outer periphery thereof is formed with a plurality of guide portions 21 in a ring-like shape, a plurality of communicating grooves 22, a plurality of attaching and detaching through grooves 23 and a plurality of holding grooves 24 as shown by FIG. 4 and the like. The respective groves 22 through 24 and a plurality of engaging projected portions 37 constitute holding means for holding a crown 31, mentioned later, attachably and detachably to and from the case body outside projected portion 20*a*. According to the embodiment in which the winding stem pipe 20 is made of a metal, the respective grooves 22 through 24 are provided by machining.

The guide portions 21 are formed at an outer periphery of the case body outside projected portion 20*a* on a side of the inserting portion 20*b* continuously in a peripheral direction. The case body outside projected portion 20*a* is disposed on a side opposed to the inserting portion 20*b* by constituting a boundary therebetween by the guide portion 21 and includes a plurality, for example, four of peripheral face regions 25. The respective peripheral face regions 25 are provided at constant intervals in the peripheral direction of the case body outside projected portion 20*a*.

Among the peripheral face regions 25, the communicating grooves 23 extended in an axial direction of the winding stem pipe 20, in other words, in an axial direction of the case body outside projected portion 20*a* are respectively formed. Ends of the four communicating grooves 23 on one side constitute dead ends at the guide portion 21 and ends thereof on the other side are opened to an end face of the case body outside projected portion 20*a*.

The holding grooves 24 are respectively provided at the peripheral face regions 25 and are contiguous to the communicating grooves 23 along the peripheral direction of the case body outside projected portion 20*a*. Specifically, the holding grooves 24 are respectively provided at the peripheral face regions 25 by notches in a recess shape closed to be opposed to the guide portion 21 and having depth faces opposed to the guide portion 21 to constitute a dead end shape. A length of the holding groove 24 in a direction orthogonal to the depth, in other words, a length of the holding groove 24 along the peripheral direction of the case body outside projected portion 20*a* is equal to a width of the communicating groove 23.

Each peripheral face region 25 includes a first peripheral face portion 25*a* and a second peripheral face portion 25*b* partitioning both ends in a longitudinal direction of the holding groove 24 by providing the holding groove 24 thereto and forms a substantially square bracket-shape as shown by FIG. 4. According to the embodiment, both of the first peripheral face portion 25*a* and the second peripheral face portion 25*b* are separated from the guide portion 21 and the communicating grooves 22 are respectively formed between the peripheral face portions 25*a*, 25*b* and the guide portion 21. The communicating grooves 22 are provided to extend in the peripheral direction of the case body outside projected portion 20*a*, in other words, along a direction of rotating the crown 31, mentioned later, rotated along the peripheral direction. The respective communicating grooves 22 communicate the through grooves 23 and the holding grooves 24 contiguous to each other to interpose the first peripheral face portion 25*a* or the second peripheral face portion 25*b*.

The crown designated by notation 31 in FIG. 1 through FIG. 3 is made of a metal and is formed by a crown main portion 32, a crown cylinder portion 33 integrally projected from a center portion thereof to a rear side, and a ring 35.

The crown main portion 32 includes a cover portion 32*a* for surrounding a root side portion of the crown cylinder portion 33 and a ring-like groove 34 to be inserted with the case body outside projected portion 20*a* is formed between the cover portion 32*a* and the root side portion of the crown cylinder portion 33. The crown cylinder portion 33 is inserted to an inner side of the winding stem pipe 20 to be extractable and retractable in an axial direction thereof. A waterproof packing 36 made of rubber constituting a ring-like shape is attached to a packing attaching groove in a ring-like shape formed at an outer periphery of the crown cylinder portion 33. The waterproof packing 36 is pinched between an inner periphery of the winding stem pipe 20 and an outer periphery of the crown cylinder portion 33 by being elastically deformed in a compressed state to serve to waterproof therebetween.

Figure 5:
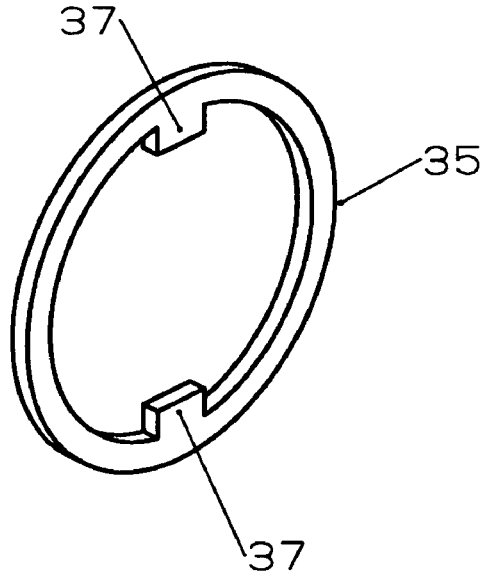
FIG. 5 is a perspective view showing a ring of the crown provided to the wristwatch according to the first embodiment.

The ring 35 is calked to the cover portion 32*a* covering the case body outside projected portion 20*a* to be disposed at an opening portion of the ring-like groove 34. The ring 35 is made of a metal and integrally includes a plurality, for example, two of engaging projected portion 37 at an inner periphery thereof to be spaced apart from each other by 180 degrees as shown by FIG. 5 and the like. A width of the engaging projected portion 37 is more or less shorter than a width of the through groove 23 and a length of the holding groove 24 and a thickness of the engaging projected portion 37 is thinner than a width of the communicating groove 22 to be able to pass the communicating groove 22. Further, the ring 35 may be constituted by a ring-like shape and the ring-like shape, mentioned here, includes a ring-like shape exemplified in FIG. 5, and a shape which can be regarded substantially as a ring-like shape although the ring includes a separated portion for making the ring discontinuous at a portion thereof in a peripheral direction.

The engaging projected portion 37 is engageable and disengageable to and from the holding groove 24 by way of the through groove 23 and the communicating groove 22. By engaging the engaging projected portion 37 to the holding groove 24, the crown 31 can be held so as not to be rotated relative to the case body outside projected portion 20*a* and by disengaging the engagement, the crown 31 is disengaged from the case body outside projected portion 20*a* to permit to operate to rotate the crown 31.

As shown by FIG. 2 and FIG. 3, inside of the crown cylinder portion 33 is inserted with a winding stem 41 of the timepiece movement from an inner portion to an outer portion of the case body 13 and contained with an urge member, for example, a coil spring 43 supported by the winding stem 41 for urging the crown 31 to outside of the case body 13 via a spring receive 42. The timepiece movement is rotated in cooperation with operation of rotating the crown 31 in a state of disengaging the crown 31 from the case body outside projected portion 20*a*, in other words, a lock release state as shown by FIG. 3. Thereby, time is set or the like.

In order to attach the crown 31 to the case body outside projected portion 20*a* after operating the crown, the crown 31 is attached thereto by pushing to rotate the crown 31 in a state of connecting the winding stem 41 to the crown cylinder portion 33.

Figure 6A:
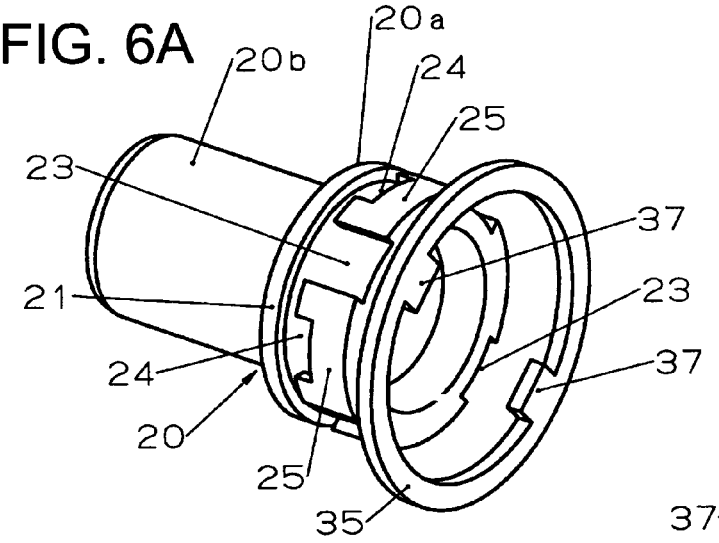
FIG. 6A through FIG. 6D are perspective views showing a procedure of attaching the crown to the winding stem pipe of the wristwatch according to the first embodiment by a relationship between the case body outside projected portion and the ring.
Figure 6B:
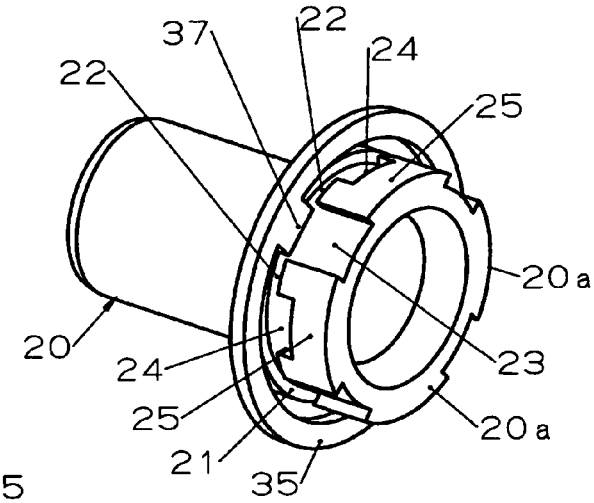

In details, first, as shown by FIG. 6A, the pair of engaging projected portions 37 of the crown 31 are matched to the pair of attaching and detaching through grooves 23 spaced apart from each other by 180 degrees in the peripheral direction of the case body outside projected portion 20*a*, and the crown 31 is pushed to move to the case body 13 against an urge force of the coil spring 43 while passing the engaging projected portion 37 through the through grooves 23. Thereby, in a state in which the case body outside projected portion 20*a* is covered by the cover portion 32*a*, the engaging projected portion 37 is butted to the guide portion 21 of the case body outside projected portion 20*a*. Therefore, further pushing is hampered and as shown by FIG. 6B, the engaging projected portion 37 is positioned to a position opposed to the communicating groove 22.

Figure 6C:
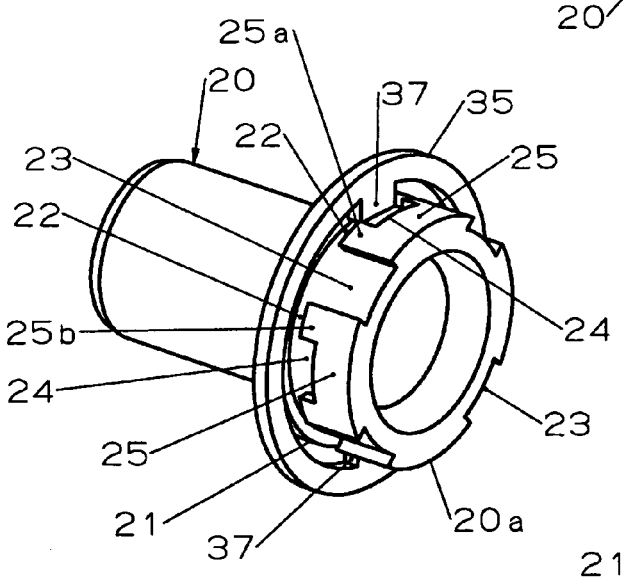

Next, under the state, the crown 31 is rotated by a predetermined angle (for example, 45 degrees) while making the engaging projected portion 37 stay to be along the guide portion 21. Thereby, as shown by FIG. 6C, the engaging projected portion 37 is arranged at a position opposed to the holding groove 24 by passing the communicating groove 22 from the through groove 23. In this case, as mentioned above, the engaging projected portion 37 is guided by the guide portion 21 and therefore, the engaging projected portion 37 is not caught by the first peripheral face portion 25*a* or the second peripheral face portion 25*b* and the engaging projected portion 37 can smoothly passed through the communicating groove 22.

After operating to push to rotate the crown 31 in this way, the crown 31 is released from being pushed. In accordance therewith, the crown 31 is pushed back from a case body outside face 13*a* by the spring force of the coil spring 43 and therefore, the engaging projected portion 37 is brought into the holding groove 24 opposed thereto and is caught by the holding groove 24. By catching the engaging projected portion 37 to a depth face of the holding groove 24, the engaging projected portion 37 is positioned such that the crown 31 is not moved further in a direction of separating from the case body outside face 13*a* along the axial direction of the case body outside projected portion 20*a*, by catching the engaging projected portion 37 by the first peripheral face portion 25*a* and the second peripheral face portion 25*b* partitioning the both ends of the holding groove 24, the crown 31 is positioned in the peripheral direction of the case body outside projected portion 20*a* and the crown 31 can be held (locked) not to be rotated. The holding state is shown in FIG. 2 and FIG. 6D.

In carrying the portable timepiece 11, the crown 31 is locked as described above and therefore, it can be prevented that the crown 31 is rotated unpreparedly and time display or the like is changed. Waterproof between the winding stem pipe 20 and the case body 13 in carrying the portable timepiece 11 can be ensured by fixing the winding stem pipe 20 and the case body 13 in water tight by a grazing member (not illustrated), and waterproof between the winding stem pipe 20 and the crown cylinder portion 33 inserted to the inner side can be ensured by the waterproof packing 36 interposed therebetween by being elastically deformed in the compressed state.

Figure 6D:
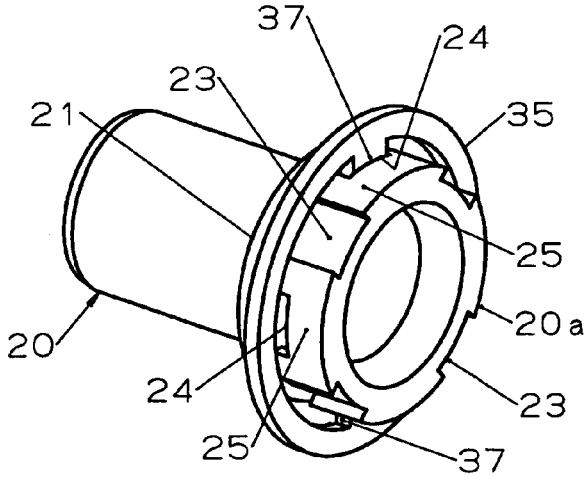

Further, when time is set or the like, as described above, contrary to the case of locking the crown 31 to the case body outside projected portion 20*a*, the crown 31 is operated to push to rotate to successively provide a state of FIG. 6B from a state of FIG. 6D. Even in operation of pushing to rotate, the engaging projected portion 37 is butted to the guide portion 21, the engaging projected portion 37 is positioned to the communicating groove 22, under the positioning, the engaging projected portion 37 can be guided to the through groove 23 by smoothly passing the engaging projected portion 37 through the communicating groove 22 by guiding the engaging projected portion 37 by the guide portion 21. Thereafter, the crown 31 is released from being pushed. Thereby, as shown by FIG. 3 and FIG. 6A, the crown 31 can be disengaged from the case body outside projected portion 20*a*. Further, by pulling out the crown 31 by the hand against the spring force of the coil spring 43 from the state and operating to rotate the crown 31, time can be set or the like.

As described above, the crown 31 is held not to be rotated unpreparedly relative to the case body outside projected portion 20*a* in an unoperated state thereof and therefore, the portable timepiece 11 having the above-described constitution is constructed by a constitution which does not need screw portions brought in mesh with each other at the case body outside projected portion 20*a* and the crown 31. Therefore, even when operation of the crown is left for a long period of time, when the crown 31 is released from being locked to the case body outside projected portion 20*a*, an abnormally large operating force is not needed. Further, the crown 31 can be attached and detached to and from the case body outside projected portion 20*a* simply by operating to push to rotate the crown 31. Further, the holding mean for locking the crown 31 so as not to be rotated unpreparedly relative to the case body outside projected portion 20*a* is difficult to be damaged in accordance with operation of attaching and detaching the crown 31 since the holding mean does not utilize mesh of screws and durability thereof is high.

Further, as described above, according to the constitution of attaching and detaching the crown 31 to and from the case body outside projected portion 20*a* in accordance with operation of pushing to rotate, a rotational force can effectively be restrained from being exerted to the winding stem pipe 20 by pushing to rotate the crown 31. Therefore, even in a case in which the winding stem pipe 20 is not attached to the case body 13 by brazing bonding but attached thereto by screwing, there is not a concern of loosening the winding stem pipe 20 in accordance with operation of attaching and detaching the crown 31 to and from the case body outside projected portion 20*a*, the waterproof function between the case body 13 and the winding stem pipe 20 is not deteriorated and therefore, an initial quality can be maintained over a long period of time.

Further, according to the embodiment, the outer periphery constituting a circular shape of the case body outside projected portion 20*a* of the winding stem pipe 20 is provided with respectives of the communicating groove 22, the attaching and detaching through groove 23 and the holding groove 24 of the holding means by grooving and therefore, workability of the grooves is excellent. Furthermore, the engaging projected portion 37 of the holding means is provided at the ring 35, the ring 35 is fixed to the cover portion 32*a* of the crown 31 covering the case body outside projected portion 20*a* and therefore, it is not necessary to machine the engaging projected portion 37 on the inner side of the cover portion 32*a*, the engaging projected portion 37 can be worked to the ring 35 in a single state and therefore, workability thereof is excellent. Therefore, the constitution is preferable in view of capable of reducing cost of working parts.

Figure 7:
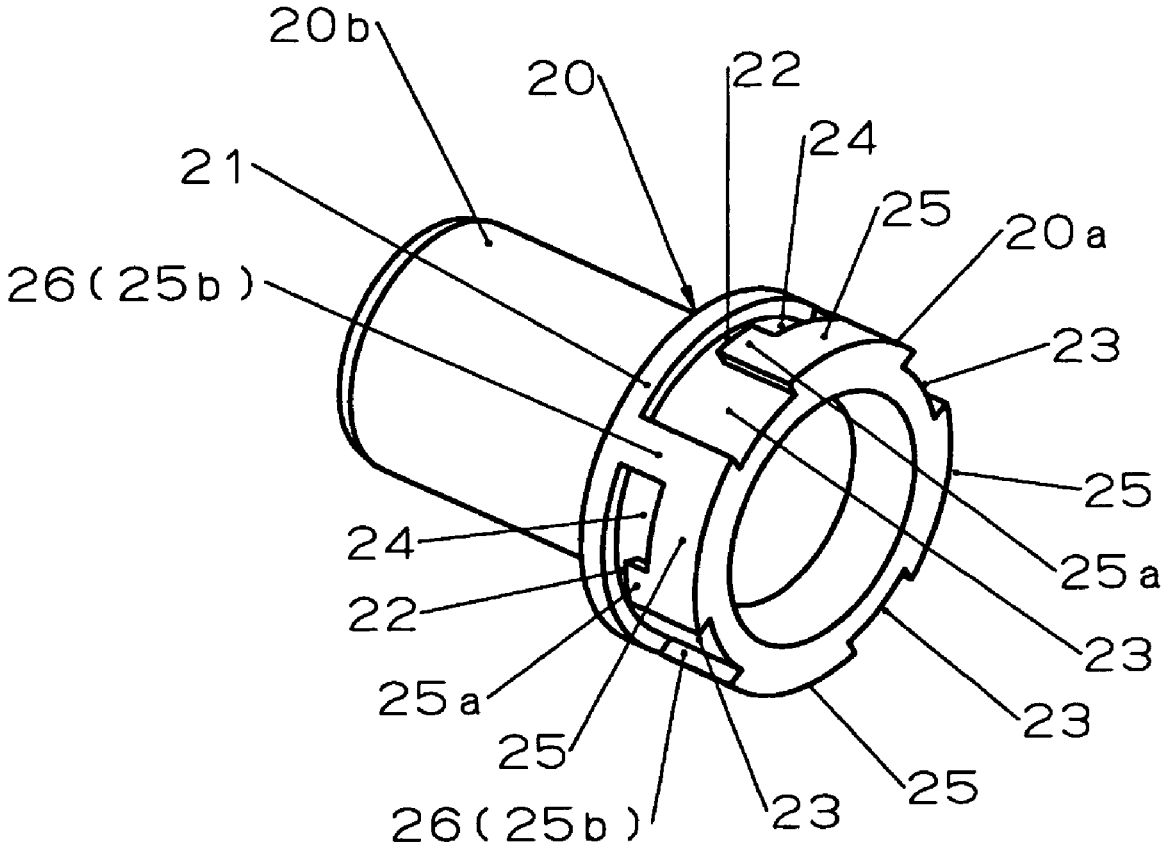
FIG. 7 is a perspective view showing a winding stem pipe provided to a wristwatch according to a second embodiment of the invention.
Figure 8:
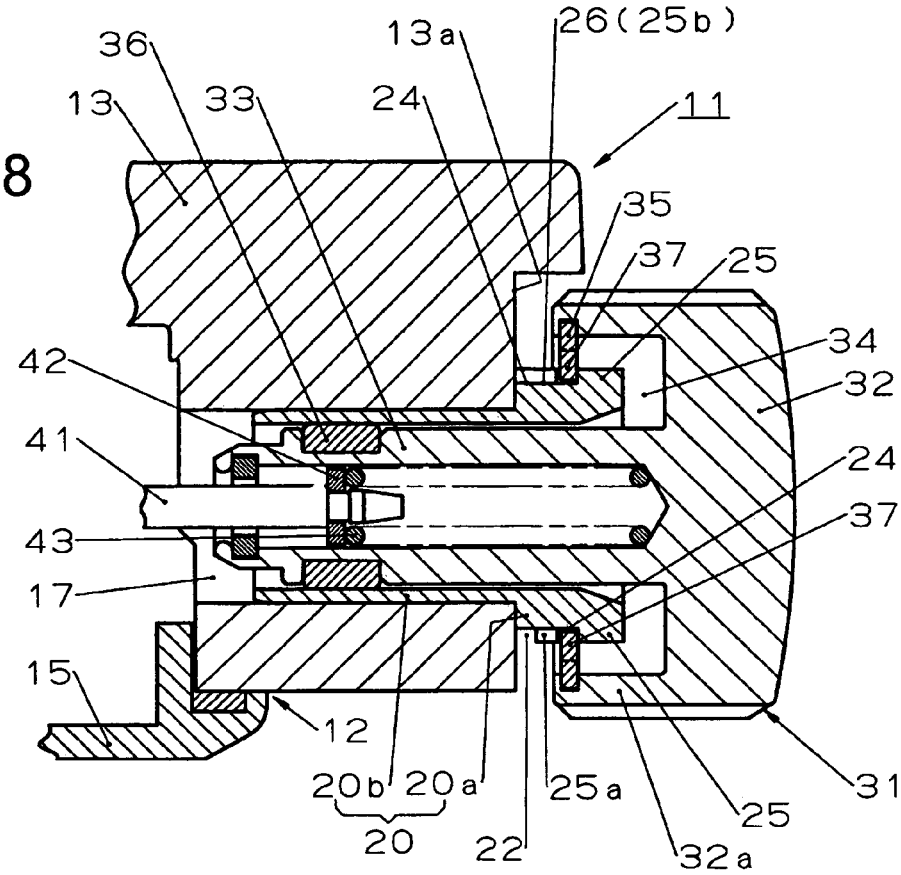
FIG. 8 is a sectional view showing a surrounding of a crown of a wristwatch according to a third embodiment of the invention in a state of holding the crown at a case body outside projected portion.
Figure 9:
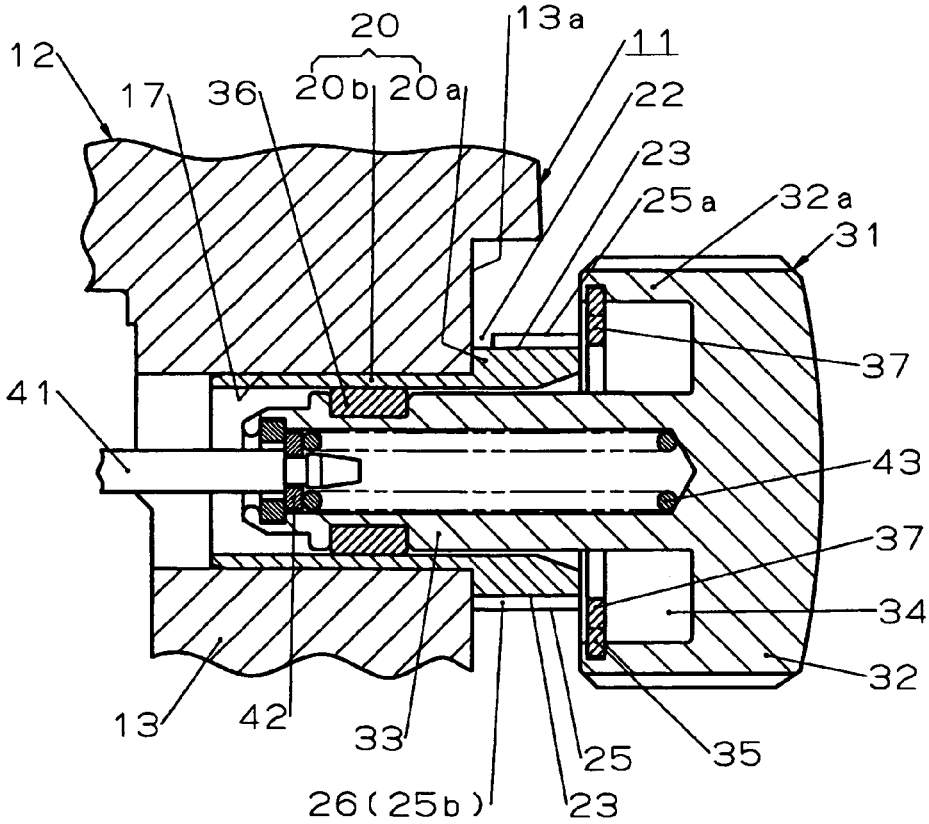
FIG. 9 is a sectional view showing the surrounding of the crown of the wristwatch according to the third embodiment in a state of disengaging the crown from the case body outside projected portion.
Figure 10:
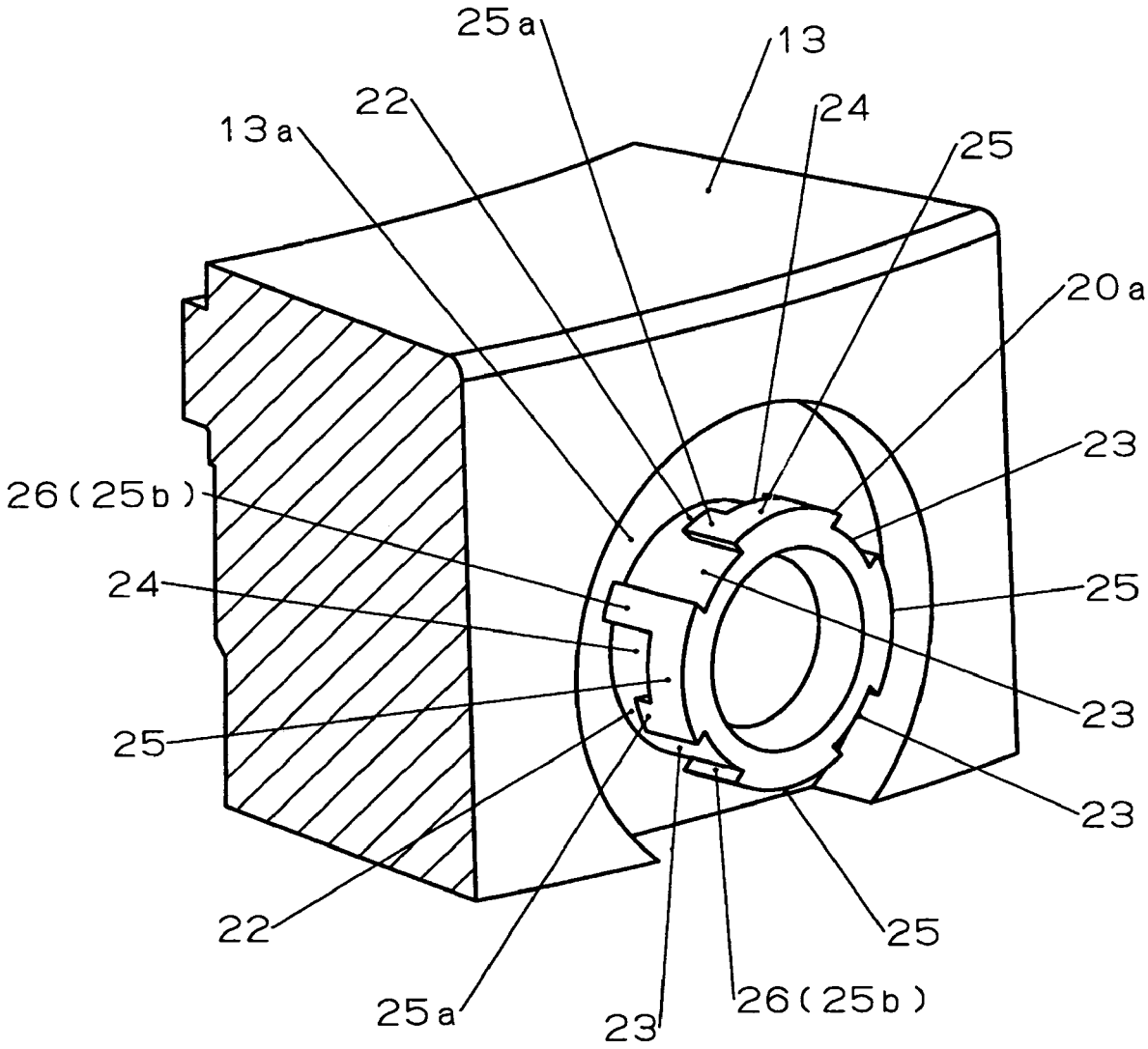
FIG. 10 is a perspective view showing a surrounding of a crown attaching portion of the wristwatch according to the third embodiment in a state of removing the crown.
Figure 11:
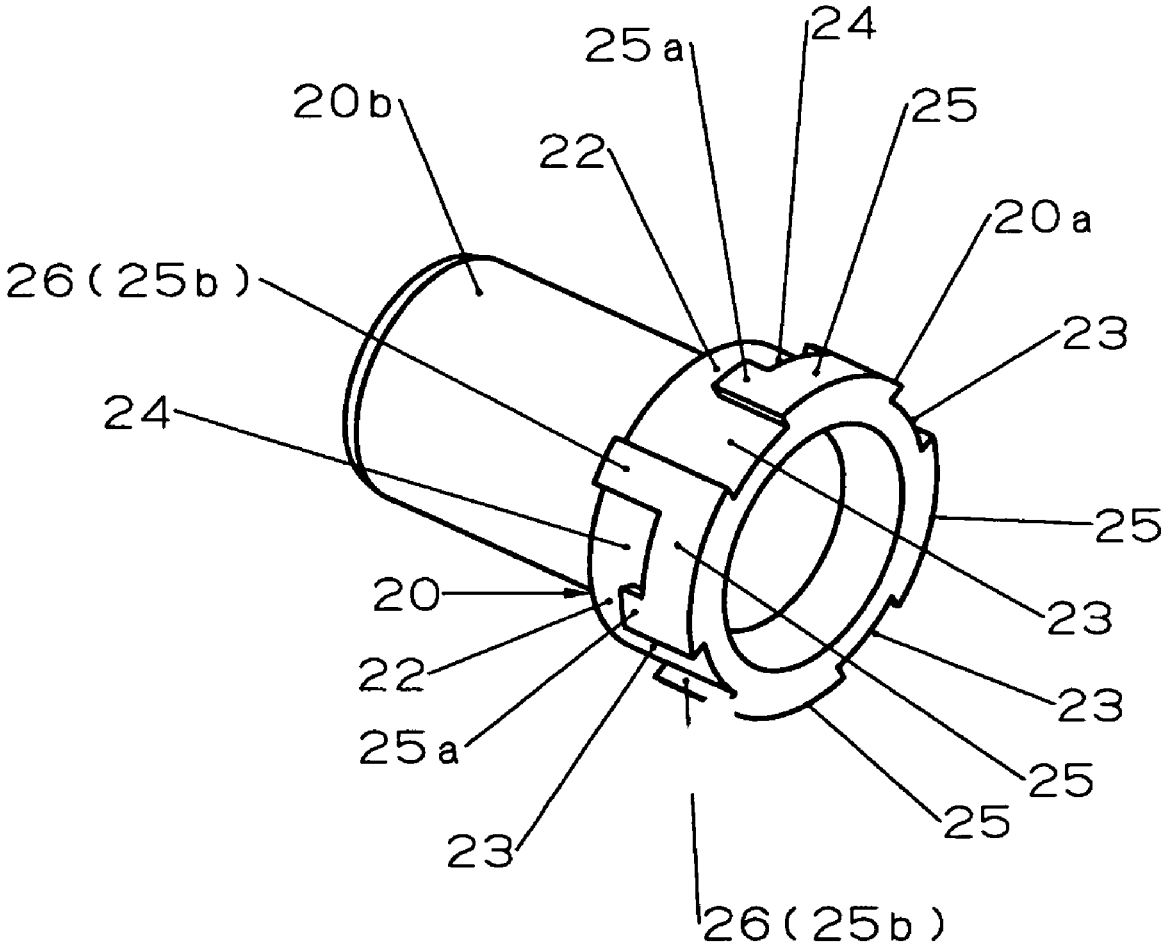
FIG. 11 is a perspective view showing a winding stem pipe provided to the wristwatch according to the third embodiment.

FIG. 7 shows a second embodiment of the invention. The second embodiment is basically the same as the first embodiment and therefore, constitutions the same as those of the first embodiment are attached with notations the same as those of the first embodiment and an explanation thereof will be omitted and an explanation will be given of an item different from that of the first embodiment as follows.

According to the second embodiment, a rotation stop portion 26 formed by one of the first peripheral face portion 25*a* and the second peripheral face portion 25*b* of the peripheral region 25, for example, the second peripheral face portion 25*b* is provided and the communicating groove 22 is provided only between the first peripheral face portion 25*a* and the guide portion 21. The rotation stop portion 26 is integrally continuous to the guide portion 21 and partitions the through groove 23 and the holding groove 24 contiguous in the peripheral direction of the case body outside projected portion 20*a*. Other than the item explained above is the same as that of the first embodiment including an item, not illustrated.

Therefore, the second embodiment can resolve the problem of the invention by achieving operation similar to that of the first embodiment. Further, according to the second embodiment, not only a depth of pushing the crown 31 can be rectified by the guide portion 21 as described above, when the crown 31 is operated to push to rotate, a rotational angle thereof can be rectified by butting the engaging projected portion 37 passing through the communicating groove 22 to the rotation stop portion 26. Thereby, a rotational direction in operating to push to rotate the crown 31 can be determined. Furthermore, the rotational angle of the crown 31 is rectified by the rotation stop portion 26 and therefore, when the crown 31 is locked, the engaging projected portion 37 can be positioned to the holding groove 24 and when the crown 31 is released from being locked, the engaging projected portion 37 can be positioned to the through groove 23. Therefore, the constitution is preferable from a view point of facilitating to operate to attach and detach the crown 31.

FIG. 8 through FIG. 11 show a third embodiment of the invention. The third embodiment is basically the same as the first embodiment and therefore, constitutions the same as those of the first embodiment are attached with notations the same as those of the first embodiment and an explanation thereof will be omitted and an explanation will be given of an item different from that of the first embodiment.

According to the third embodiment, the guide portion of the case body outside projected portion 20*a* adopted in the first embodiment is omitted and the case body outer face 13*a* serves also as the guide portion. Further, there is provided the rotation stop portion 26 formed by one of the first peripheral face portion 25*a* and the second peripheral face portion 25*b* of the peripheral face region 25, for example, the first peripheral face portion 25*a*, and the communicating groove 22 is provided only between the second peripheral portion (the other peripheral face portion) 25*b* and the case body outer face 13*a* constituting the guide portion. The rotation stop portion 26 is integrally proximate to or continuous to the case body outer face 13*a* constituting the guide portion and partitions the through groove 23 and the holding groove 24 contiguous to each other in the peripheral direction of the case body outside projected portion 20*a*. Further, the rotation stop portion can be omitted in the third embodiment. Other than the item explained above is the same as that of the first embodiment including an item, not illustrated.

Therefore, also the third embodiment can resolve the problem of the invention by achieving operation similar to that of the first embodiment. Further, according to the third embodiment, not only the depth of pushing the crown 31 can be rectified by the case body outer face 13*a* serving also as the guide portion as described above, but also in operating to push to rotate the crown 31, the rotational angle can be rectified by butting the engaging projected portion 37 passing the communicating groove 22 to the rotation stop portion 26. Thereby, the rotational direction in operating to push to rotate the crown 31 can be determined. Furthermore, the rotational angle of the crown 31 is rectified by the rotation stop portion 26 and therefore, when the crown 31 is locked, the engaging projected portion 37 can be positioned to the holding groove 24 and when the crown 31 is released from being locked, the engaging projected portion 37 can be positioned to the through groove 23. Therefore, the constitution is preferable from a view point of facilitating to operate to attach and detach the crown 31.

Furthermore, the case body outer face 13*a* serves also as the guide portion, it is not necessary to work the guide portion of the case body outside projected portion 20*a* and therefore, grooving for forming the communicating groove 22, the attaching and detaching through groove 23 and the holding groove 24 at the outer periphery of the case body outside projected portion 20*a* can be facilitated, which is preferable in view of capable of reducing cost of working the winding stem pipe 20.

Figure 12:
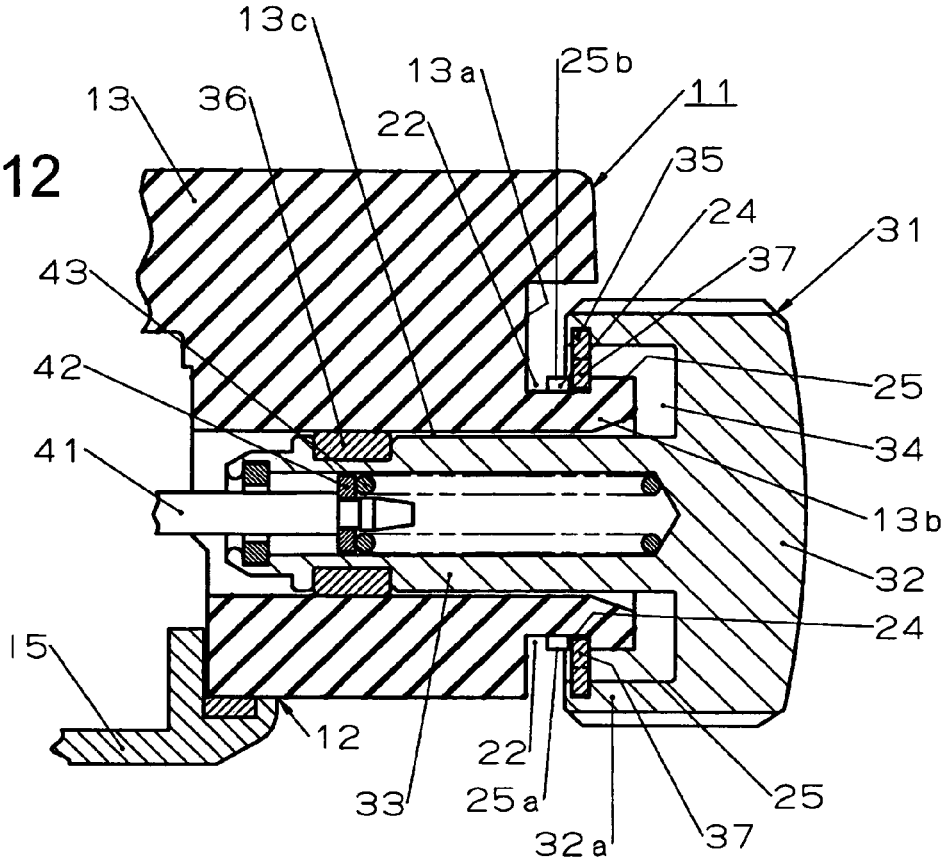
FIG. 12 is a sectional view showing a surrounding of a crown of a wristwatch according to a fourth embodiment of the invention in a state of holding the crown at the case body outside projected portion.
Figure 13:
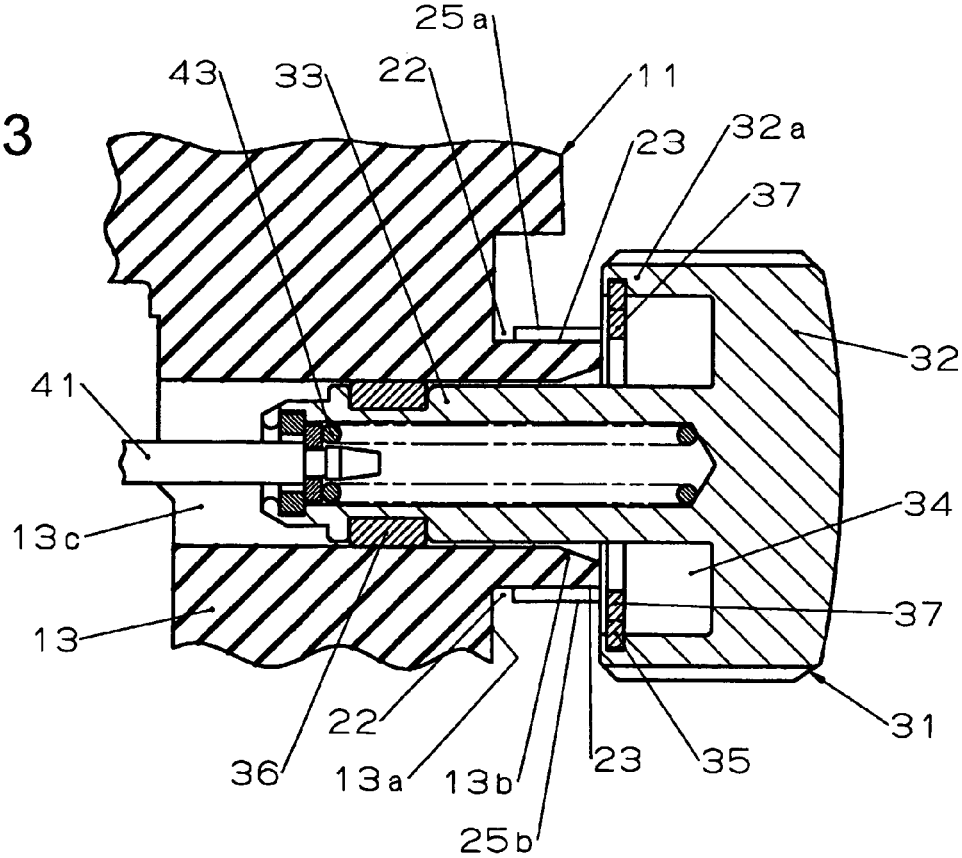
FIG. 13 is a sectional view showing the surrounding of the crown of the wristwatch according to the fourth embodiment in a state of disengaging the crown from the case body outside projected portion.
Figure 14:
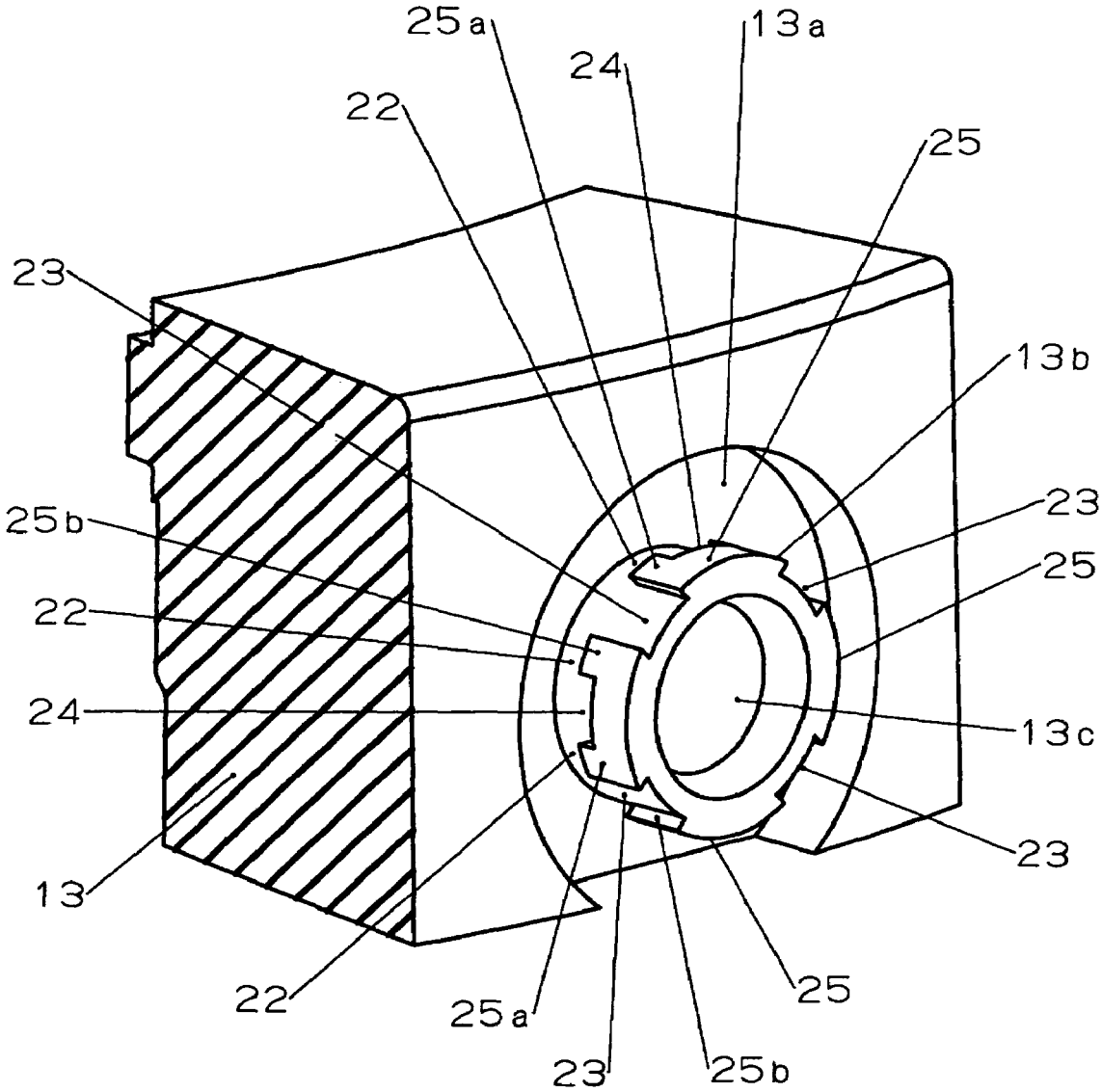
FIG. 14 is a perspective view showing the surrounding of a crown attaching portion of the wristwatch according to the fourth embodiment in a state of removing the crown.

FIG. 12 through FIG. 14 show a fourth embodiment. The fourth embodiment is basically the same as the first embodiment and therefore, constitutions the same as those of the first embodiment are attached with notations the same as those of the first embodiment and an explanation thereof will be omitted and an explanation will be given of an item different from that of the first embodiment as follows.

According to the fourth embodiment, the case body 13 is constituted by a molded member, for example, made of plastic, the case body outer face 13*a* serves also as the guide portion, and the case body outside projected portion 13*b* is integrally projected from the case body outer face 13*a*. The case body outside projected portion 13*b* is constructed by a constitution similar to that of the case body outside projected portion of the winding stem pipe explained in the first embodiment and an outer periphery thereof is formed with the plurality of communicating grooves 22 along the rotational direction of the crown 31, the plurality of attaching and detaching through grooves 23 communicated with the communicating grooves 22 and opened to the end face of the case body outside projected portion 13*b*, and the plurality of holding grooves 24 communicated with the communicating grooves 22 and contiguous to the attaching and detaching through grooves 23. Each through groove 23 is constituted by a dead end shape by the case body outer face 13*a* serving also as the guide portion. The respective communicating grooves 22 are respectively formed between the first peripheral face portions 25*a* and the second peripheral face portions 25*b* provided to the peripheral regions 25 of the case body outside projected portion 13*b* and the case body outer face 13*a* serving also as the guide portion.

The case body 13 is formed with a crown inserting hole 13*c* opened to the end face of the case body outside projected portion 13*b*. The crown cylinder portion 33 is inserted into the crown inserting hole 13*c* movably in the axial direction and an interval therebetween is waterproofed by the waterproof packing 3.6 brought into sliding contact with the crown inserting hole 13*c*. Other than the item explained above is the same as that of the first embodiment including an item, not illustrated.

Therefore, also the fourth embodiment can resolve the problem of the invention by achieving operation similar to that of the first embodiment. Further, according to the fourth embodiment, the winding stem pipe is not needed and therefore, a number of steps of attaching the winding stem pipe and a number of parts can be reduced. In addition thereto, the respective grooves 22 through 24 of the outer periphery of the case body outside projected portion 13*b* are integrally molded with the case body 13, it is not necessary to work to form the grooves 22 through 24 and therefore, a reduction in cost can be achieved.

Furthermore, when assumedly, a male screw portion is provided at the outer periphery of the case body outside projected portion 13*b* made of plastic and screwed with the crown attachably and detachably, although it is difficult to guarantee a strength of the male screw portion, according to a constitution of the outer periphery of the case body outside projected portion 13*b* adaptable to the operation of pushing to rotate the crown as described above, a strength necessarily sufficient for holding the crown 31 so as not to be rotated unpreparedly can be achieved even by the case body outside projected portion 13*b* made of plastic. Therefore, in the portable timepiece 11 having the case body 13 made of plastic, it can be realized that the crown 31 is held by the case body-outside projected portion 13*b* so as not to rotate the crown 31 in an unoperated state unpreparedly.

Figure 15:
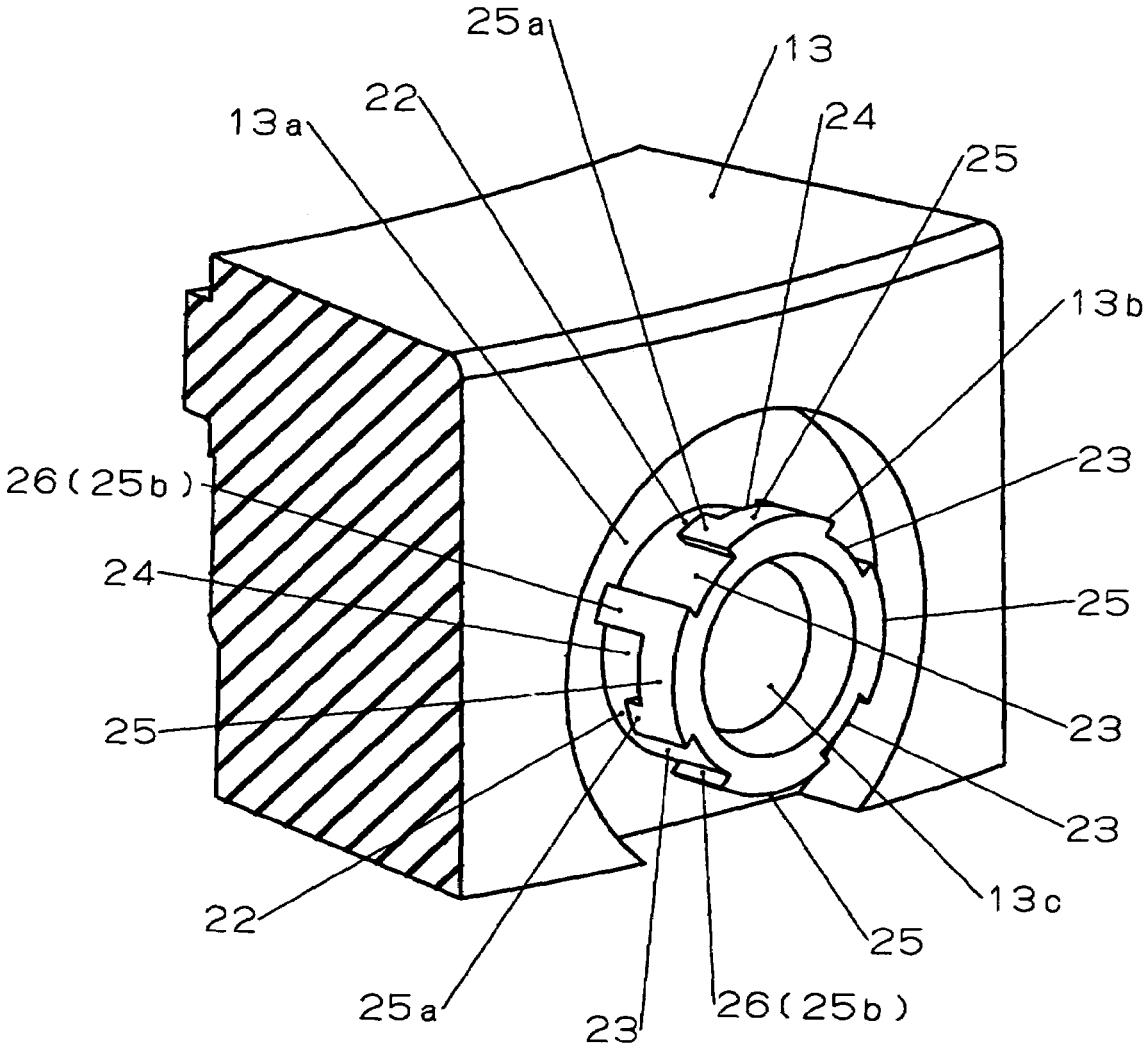
FIG. 15 is a perspective view showing a surrounding of a crown attaching portion of a wristwatch according to a fifth embodiment in a state of removing the crown.

FIG. 15 shows a fifth embodiment of the invention. The fifth embodiment is basically the same as the fourth embodiment and therefore, constitutions the same as those of the fourth embodiment are attached with notations the same as those of the fourth embodiment and an explanation thereof will be omitted and an explanation will be given of an item different from that of the fourth embodiment as follows.

The fifth embodiment is provided with the rotation stop portion 26 formed by one of the first peripheral face portion 25*a* and the second peripheral face portion 25*b* of the peripheral face region 25 of the case body outside projected portion 13*b*, for example, the second peripheral face portion 25*b* and is provided with the communicating groove 22 only between the first peripheral face portion (other peripheral face portion) 25*a* and the case body outer face 13*a* constituting the guide portion. The rotation stop portion 26 is integrally continuous to the case body outer face 13*a* constituting the guide portion and partitions the through groove 23 and the holding groove 24 contiguous in the peripheral direction of the case body outside projected portion 13*b*. Other than the item explained above is the same as that of the fourth embodiment including an item, not illustrated.

Therefore, also the fifth embodiment can resolve the problem of the invention by achieving operation similar to that of the fourth embodiment. Further, according to the fifth embodiment, not only the depth of pressing the crown 31 can be rectified by the case body outer face 13*a* serving also as the guide portion as described above but also in operating to push to rotate the crown 31, the rotational angle can be rectified by butting the engaging projected portion 37 passing the communicating groove 22 to the rotation stop portion 26. Thereby, the rotational direction in operating to push to rotate the crown 31 can be determined. Furthermore, the rotational angle of the crown 31 is rectified by the rotation stop portion 26 and therefore, when the crown 31 is locked, the engaging projected portion 37 can be positioned to the holding groove 24 and when the crown 31 is released from being locked, the engaging projected portion can be positioned to the through hole 23. Therefore, the constitution is preferable from a standpoint of facilitating to operate to attach and detach the crown 31.

The invention is not restricted by the above-described respective embodiments. For example, the invention can also be embodied by providing the communicating groove, the attaching and detaching through groove, and the holding groove of the holding means on the inner side of the cover portion of the crown (in this case, a ring previously provided with the respective grooves in accordance with machining or molding may be fittingly attached to the inner side of the cover portion) and projecting the engaging projected portion of the holding means to the outer face of the case body outside projected portion. Further, the invention is applicable also to a portable timepiece of a normal wristwatch which does not require a high pressure waterproof function, a pocket watch, or a hanging timepiece of a necklace type or the like.

According to the invention, operability of the crown can be promoted when the crown is held by the case back outside projected portion so as not to be rotated unpreparedly and when the crown is released from being held thereby, mesh of screws is not utilized for holding the crown and therefore, the portable timepiece with high durability having a constitution of holding the crown so as not to be rotated unpreparedly can be provided.

What is claimed is:

1. A portable timepiece comprising:

a case body having a pipe attaching hole;

a winding stem pipe having a case body outside projected portion arranged at an outer portion of the case body and insertingly attached to the pipe attaching hole;

a crown having a crown cylinder portion inserted into the winding stem pipe and removably provided to the case body outside projected portion;

an urging member included in the crown cylinder portion for urging the crown in a direction of separating from the case body; and holding means having a plurality of communicating grooves along a rotational direction of the crown, a plurality of attaching and detaching through grooves communicated with the communicating grooves and opened to an end face of the case body outside projected portion, a plurality of holding grooves communicated with the communicating grooves, formed in a dead end shape and contiguous to the attaching and detaching through grooves and a plurality of engaging projected portions brought to and from the respective grooves for holding the crown attachably and detachably to and from the case body outside projected portion.

2. A portable timepiece according to claim 1, wherein the communicating groove, the attaching and detaching through groove and the holding groove are provided at an outer periphery of the case body outside projected portion and the engaging projected portion is provided at a cover portion for covering the case body outside projected portion of the crown.

3. A portable timepiece according to claim 2, wherein a guide portion for guiding to move the engaging projected portion when the engaging projected portion passes the communicating groove is formed at the outer periphery of the case body outside projected portion in a ring-like shape continuously in a peripheral direction.

4. A portable timepiece according to claim 2, wherein a case body outside face of the case body serves as the guide portion for guiding to move the engaging projected portion when the engaging projected portion passes the communicating groove.

5. A portable timepiece according to claim 3, wherein the communicating groove is formed between a peripheral face portion of the case body outside projected portion disposed between one end in the peripheral direction of the case body outside projected portion of the holding groove and the through groove contiguous thereto and the guide portion, other peripheral face portion of the case body outside projected portion disposed between other end in the peripheral direction of the case body outside projected portion of the holding groove and the through groove contiguous thereto serves as a rotation stop portion, and the rotation stop portion is made to be continuous to the guide portion.

6. A portable timepiece according to claim 5, wherein the communicating groove is formed between a peripheral face portion of the case body outside projected portion disposed between one end in the peripheral direction of the case body outside projected portion of the holding groove and the through groove contiguous thereto and the guide portion, other peripheral face portion of the case body outside projected portion disposed between other end in the peripheral direction of the case body outside projected portion of the holding groove and the through groove contiguous thereto serves as a rotation stop portion, and the rotation stop portion is made to be continuous to the guide portion.

7. A portable timepiece according to claim 2, wherein the cover portion is fixed with a ring projected with the engaging projected portion to direct in an inner direction.

8. A portable timepiece comprising:

a case back comprising a molded member having a crown inserting hole and integrally having a case body outside projected portion to which the inserting hole is opened;

a crown having a crown cylinder portion inserted into the crown inserting hole and provided removably at the case body outside projected portion;

an urging member included in the crown cylinder portion for urging the crown in a direction of separating from the case body; and holding means having a plurality of communicating grooves along a rotational direction of the crown, a plurality of attaching and detaching through grooves communicated with the communicating grooves and opened to an end face of the case body outside projected portion, a plurality of holding grooves communicated with the communicating grooves, formed in a dead end shape and contiguous to the attaching and detaching through grooves, and a plurality of engaging projected portions brought to and from the respective grooves for holding the crown attachably and detachably to and from the case body outside projected portion.

9. A portable timepiece according to claim 8, wherein the communicating groove, the attaching and detaching through groove, and the holding groove are provided at an outer periphery of the case back outside projected portion and the engaging projected portion is provided at a cover portion for covering the case back outside projected portion of the crown.

10. A portable timepiece according to claim 9, wherein a case back outside face of the case back serves as a guide portion for guiding to move the engaging projected portion when the engaging projected portion passes the communicating groove.

11. A portable timepiece according to claim 10, wherein the communicating groove is formed between a peripheral face portion of the case back outside projected portion disposed between one end in a peripheral direction of the case back outside projected portion of the holding groove and the through groove contiguous thereto and the guide portion, other peripheral face portion of the case back outside projected portion disposed between other end in the peripheral direction of the case back outside projected portion of the holding groove and the through groove contiguous thereto serves as a rotation stop portion, and the rotation stop portion is made to be continuous to the guide portion.

12. A portable timepiece according to claim 9, wherein the cover portion is fixed with a ring projected with the engaging projected portion to direct in an inner direction.

* * * * *